US005168676A

United States Patent [19]

Berg et al.

[11] Patent Number: 5,168,676

[45] Date of Patent: Dec. 8, 1992

[54] HORIZONTALLY RIBBED DOME FOR HABITATION ENCLOSURE

[76] Inventors: Robin Berg; Timothy Berg, both of 1088 Nelson Farm Rd., Hudson, Wis. 54016

[21] Appl. No.: 681,900

[22] Filed: Apr. 8, 1991

[51] Int. Cl.[5] ..... E04B 1/32

[52] U.S. Cl. ..... 52/80; 52/169.6

[58] Field of Search ..... 52/80, 83, 169.6, 658, 52/223 R

[56] References Cited

U.S. PATENT DOCUMENTS 1,402,077 1/1922 Lanchester ..... 52/83

2,812,769 11/1957 Schaefer et al. ..... 52/80

4,574,108 3/1986 Fakirov et al. ..... 52/658

4,671,189 9/1987 David ..... 52/169.6

4,879,859 11/1989 Dykmans ..... 52/223 R

*Primary Examiner*—James L. Ridgill, Jr.

*Attorney, Agent, or Firm*—Oblon, Spivak, McClelland, Maier & Neustadt

[57] ABSTRACT

Domes for enclosing human habitations are prepared from graphite-reinforced composite trusses and panels of clear plastic. The domes are provided on the exterior with a plurality of horizontally disposed, circumferentially extending ribs, to reduce lift and draft coefficients.

6 Claims, 9 Drawing Sheets

HORIZONTALLY RIBBED DOME FOR HABITATION ENCLOSURE

BACKGROUND OF THE INVENTION

1. Field of the Invention

This invention pertains to domes for the enclosure o vast areas suitable for human working and dwelling. More specifically, domes having a minimum radius of one-half mile are provided with horizontal ribs about the exterior surface. These ribs lessen the dome's lift and drag coefficients thus reducing the wind forces that must be borne by the structure. Domes so constructed could be used to enclose self supporting land or sea based cites with dwellings, businesses and factories, parks and nature areas as well as agriculture and aquaculture. Although a purpose-designed domed city could be truly three dimensional, domes could also be placed over existing cities.

2. Background of the Prior Art

Mankind has envisioned the provision of dome-enclosed life supporting habitats for many years ranging from futuristic Science Fiction to serious engineering symposia. For example, domes enclosures for cites of distant planetary bodies have long been conceptualized as a method of protecting colonists from a hostile environment until the colonized world can be "terraformed." Additionally, the concept of floating cities was explored at the 1971 symposium of the International Association for Shell Structures with published proceedings (Pacific Symposium Part I, ed. Rudolph Szilard).

A need for large enclosed areas may also exist for more down to earth, land based applications. Curtis Charles has recently proposed that Trinidad and other equatorial countries build dome enclosed, combined hydroponic agriculture and aquaculture facilities that utilize natural light to help their agricultural and fishing industries (Technology Review, Vol. 93, Nol. 5, June 1990, p. MIT 36). Similarly, hostile polar locations or areas suffering drastic climactic changes, such as due to possible effects of global warming, could be made habitable by employing suitable, domed enclosures.

Accounting for loads on the structure is of primary importance in designing such very large domes, that is, domes having a radius of at least one half mile. The three largest loading factors are material weight loads; passive moisture loads including snow, ice, rain and condensation; and wind loads.

Loads from the dome materials themselves are substantial in domes of the size here considered, but they are constant and therefore predictable and can be accounted for. Passive moisture loads are less predictable but vary relatively slowly and thus may be accommodated by assuming some upper bound on their magnitude. The most problematic loads are those induced by the wind. Wind loads can vary rapidly and nonuniformly and are thus difficult to account for. Their effects can be further amplified when coupled with snow, rain, or hail. But the air flow about the dome can be controlled, to some extent, in the dome design thereby minimizing the effects of impacting winds. In particular, the lift and drag coefficients may be reduced to lessen the associated lift and drag forces on the dome. Further, deflectors may be situated about the dome so as to diminish the effects of projectiles associated with the wind.

SUMMARY OF THE INVENTION

To minimize lift and drag coefficients, a dome of radius of at least one half mile is provided with circumferentially extending horizontal ribs on the exterior surface of the dome. The horizontal ribs break up and direct the air flow across the dome, reducing both the drag and lift coefficients as compared to plain domes or other modified domes. Wind tunnel tests showed the lift and drag reductions obtained with the horizontally ribbed domes to be greatest at higher wind velocities, where the effects of wind are most worrisome.

Wind deflectors are useful in reducing the lift coefficient over the dome, though their main usefulness would be in deflecting projectiles up and over the dome.

One suitable design for human habitation would be a truss-supported dome, consisting of a plurality of pie-shaped arched trusses, evenly spaced around the dome's circumference. The arched trusses would support a clear, preferably plastic, outer material, and provide support for external loadings, prepared from graphite reinforced laminates, such as resin matrices of vinylester resins reinforced with graphite fibers. The graphite trusses, optionally supported by a central tower of graphite reinforced laminate, support sections of a clear plastic, such as styrene methylmethacrylate (SMMA).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

As noted above, the enclosing dome must be designed to resist three distinct types of external forces. One of these, the material load, is a constant value, whereas the loads applied by snow/ice and winds are variable. In order to ensure safety, the structure must be designed to resist maximum snow loading. A foreseeable maximum loading for snow or ice is a pressure of 20 lbs./sq.ft., exerted on the dome surface. The overall applied load due to snow loading is computed by the Formula I.

$$F\,\text{snow} = P\,\text{snow (surface area)} \quad \text{(I)}$$

F snow = (20 lbs./sq.ft.) (37,924,368 sq. ft. for a ½ mile radius hemispherical dome)

F snow = 75,848,736 lbs.

To resist forces of this type, it will be necessary to provide materials of extreme strength, while reducing weight as much as possible, to minimize material weight loads. Easy manufacturing and machinability are also desirable features. Moreover, it is believed that human habitation will be enhanced by provision of a material which admits at least some natural light. Two materials that meet these demands are graphite reinforced laminate materials, such as resin matrices reinforced with graphite fibers, and styrene methylmethacrylate (SMMA), in sheet or panel form. Graphite exhibits excellent stiffness and strength, as compared with steel or related metal materials, and is much lighter, and has better environmental stability. Articles of extremely high stiffness and strength can be prepared from resins, such as epoxy or vinyl-ester resins and the like, reinforced with graphite fibers or filaments. These compositions, per se, are well known in the art, and do not constitute an aspect of the invention. The preparation of articles of extreme strength is facilitated by the provision of oriented tows or continuous fibers of graphite, which maximize strength in specific directions.

A clear plastic, which exhibits high strength/weight characteristics and environmental stability is SMMA. The light transmitting characteristics of SMMA are generally considered better than conventional glass. The load handling capabilities of this plastic are excellent, and the SMMA compositions readily available to those of ordinary skill in the art retain their physical properties, even after exposure to high radiation levels, which may be a consideration for the construction of domed cities in non-terrestrial environments, or in an changing environment on earth.

Figure 8:
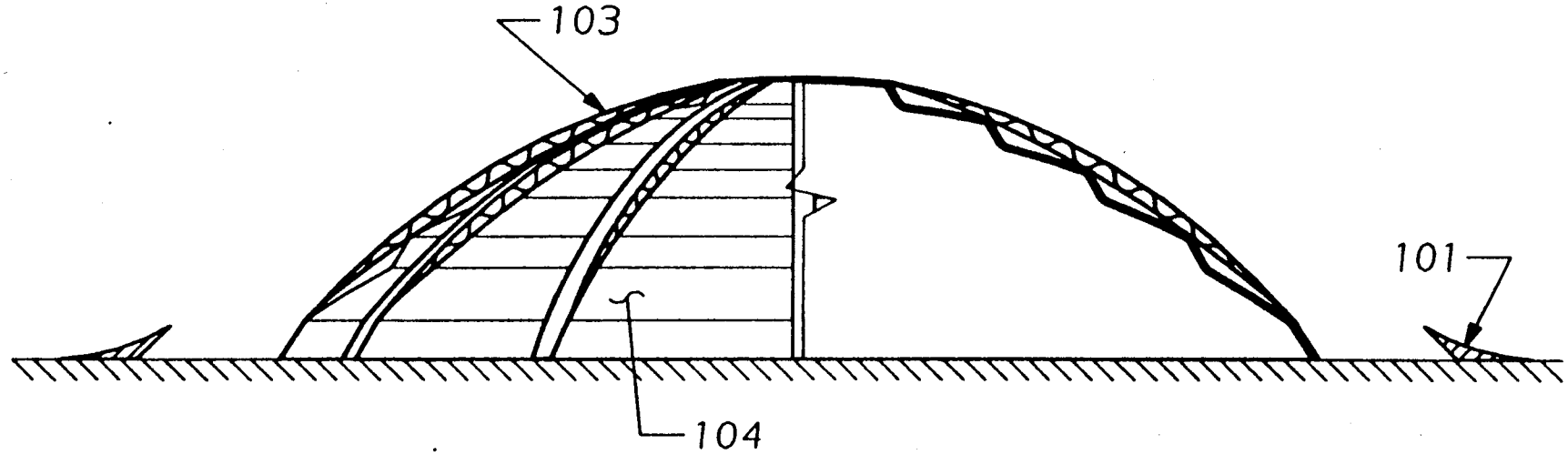
FIG. 8. Illustration of a dome with a wind deflector and verticle truss ribs.
Figure 9:
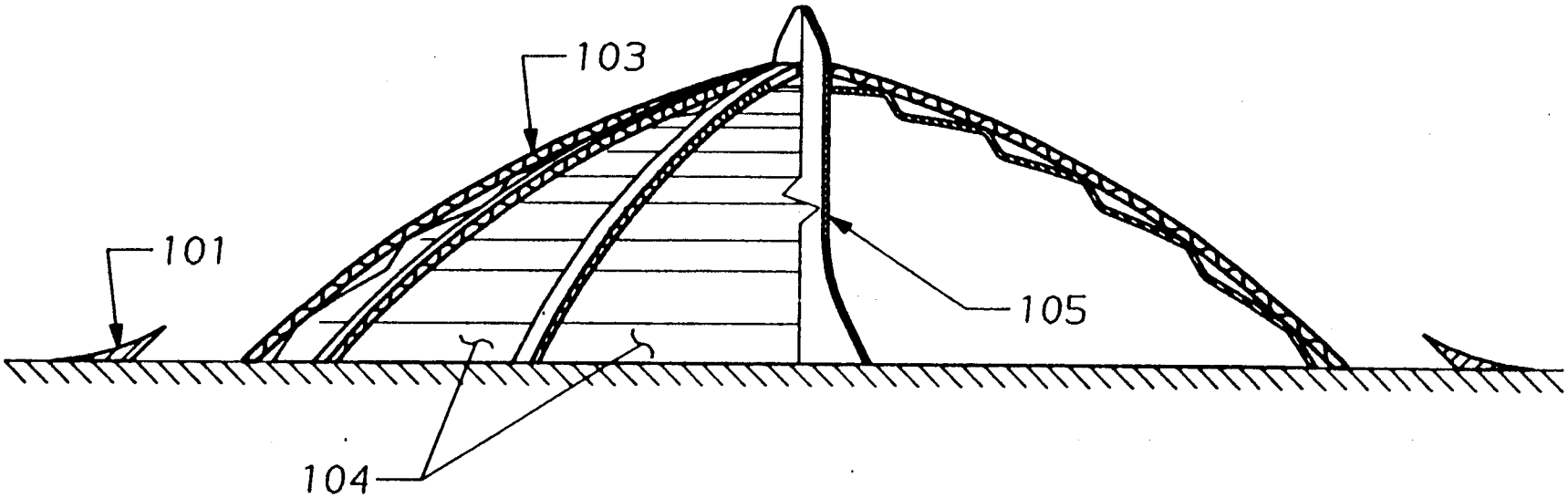
FIG. 9. Illustration of a dome with a wind deflector and verticle truss ribs and a center structure tower.

These two materials can be combined in a truss-supported dome design, illustrated in FIG. 8 and 9. Thus, a plurality of trusses 103 prepared from laminated graphite-reinforced composites are spaced around the dome circumference. Between individual trusses, panels of clear SMMA 104 are provided, locked into the trusses. The resulting dome has extremely high strength characteristics, with a low materials weight load, such that it can withstand the enormous crushing pressure described above for the maximum snow loading conditions.

For ease of construction, a central graphite tower 105 may be provided at the center of the dome. Each of the trusses 103 may be "locked in" to the tower, and the panels of SMMA lifted and fitted in by crane or similar device. It is immediately clear that the number of trusses provided is variable, and will change according to the strength and stiffness characteristics of the material employed in construction of the truss, and the loading conditions to which the dome is exposed.

As noted, the dome is also exposed the variable loading applied by wind. This loading has two components or parameters, the lifting force and drag force applied by a windstream. Again, in order to provide a safety factor, the dome must be designed to exceed predicted maximum loads.

Lifting force is computed according to Formula II.

$$L\max = 0.5Ap(V\max) - \text{(maximum lift coefficient)} \quad \text{(II)}$$

where

A = projected area of dome bottom $= \pi$(dome radius) 2 $= \pi$(2649 ft) 2 = 21,895,644 sq.ft.

p = air density = 0.00238 slug/cu.ft.

Vmax = maximum air velocity = 400 mph = 586.7 ft/s

In order to provide an adequate safety factor, the dome enclosure must be designed to withstand approximately twice the maximum lifting force. It is immediately clear from Formula II that the maximum lifting force and thus design load for the dome, can be reduced by reducing the lift coefficient.

Similarly, the drag force of an applied windstream is computed according to Formula III.

$$D\max = 0.5p(V\max) - \text{(Maximum Drag Coefficient)}$$

where

A = projected area of dome profile = 0.5)1320 ft)(2640 ft + 5280 ft) = 5,227,200 sq.ft.

p = air density = 0.00237 slug/cu.ft.

Vmax = maximum air velocity = 586.7 ft/s

Again, the inventive dome should be designed to resist twice the computed maximum load, to provide a safety factor. As with the lifting force, reduction of the variable component of the formula, in this case maximum drag coefficient, results in a sharp reduction in load.

Applicants have discovered that both lift and drag coefficients of a dome having a minimum half mile radius can be effectively reduced by providing circumferentially extending horizontal ribs 102 along the external surface of the dome. In a preferred embodiment, illustrated in FIG. 7, these ribs are themselves dome-shaped in a transverse cross-section, whereby the ribs, in abutting relationship, provide channels for diverting the air. The horizontal ribs apparently divert or break up the airstream, reducing both drag and lift coefficients. A drag and lift coefficient reducing effect is also obtained when the horizontally provided ribs are spaced, laterally, one from another, although the result is not as great as the situation where ribs of equivalent size abut each other. The minimum size of the rib necessary is one that can effectively project into the airstream formed by the dome envelope. For a half mile radius dome, the calculated minimum height for a rib is 10 feet. At larger ribs, there is a trade off between added weight and drag and lift coefficient reduction. Based on empirical studies using modeling and wind tunnels, lift coefficients of approximately 0.09 and drag coefficients of approximately 0.17, should be obtainable for the dome described herein. Changes in dimensions will of course effect ultimate lift and drag coefficients.

The described design was compared, in wind tunnel testing, with a variety of dome designs, including domes provided with a rotary top to invert lift, domes provided with wind deflectors, dimpled domes, and domes provided with vertical ribs. Surprisingly, minimum lift and drag coefficients were obtained using the claimed design, wherein the dome is provided with horizontal ribs.

Figure 1:
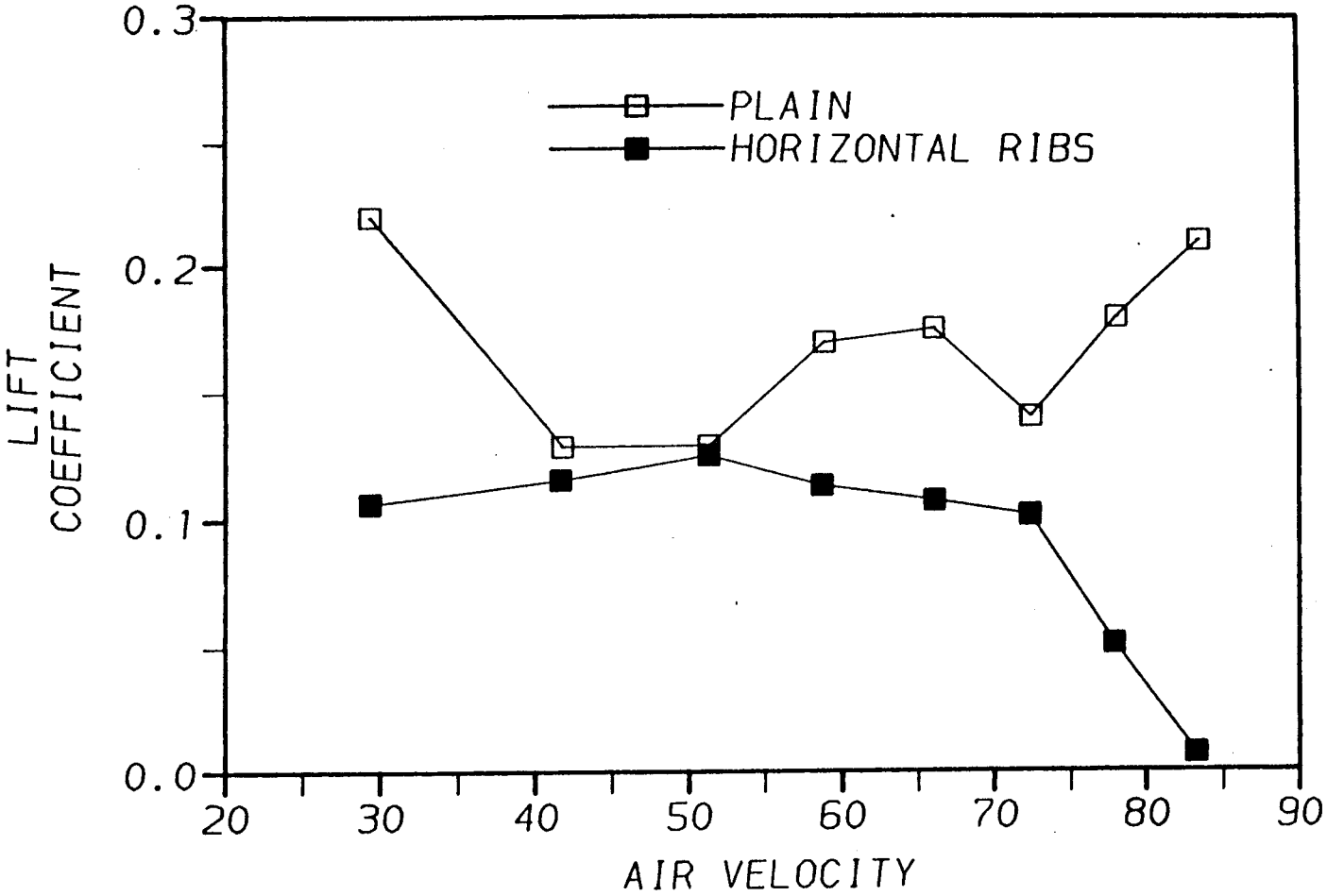
FIG. 1. Wind tunnel data of the lift coefficients of a plain dome and a horizontally ribbed dome, showing the reduction obtained with the horizontal ribs.
Figure 2:
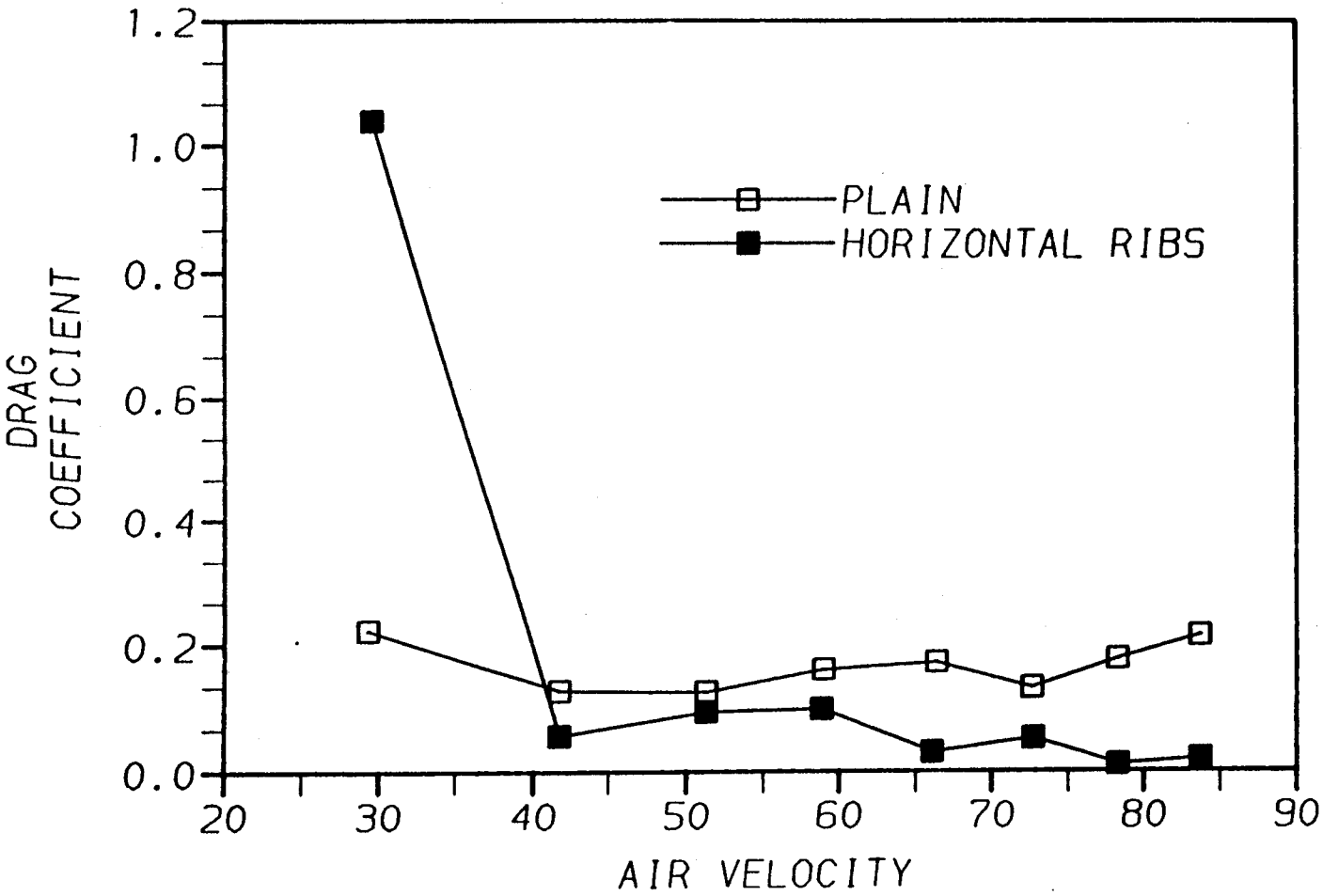
FIG. 2. Wind tunnel data of the drag coefficients of a plain dome and a horizontally ribbed dome, showing the reduction obtained with the horizontal ribs.
Figure 3:
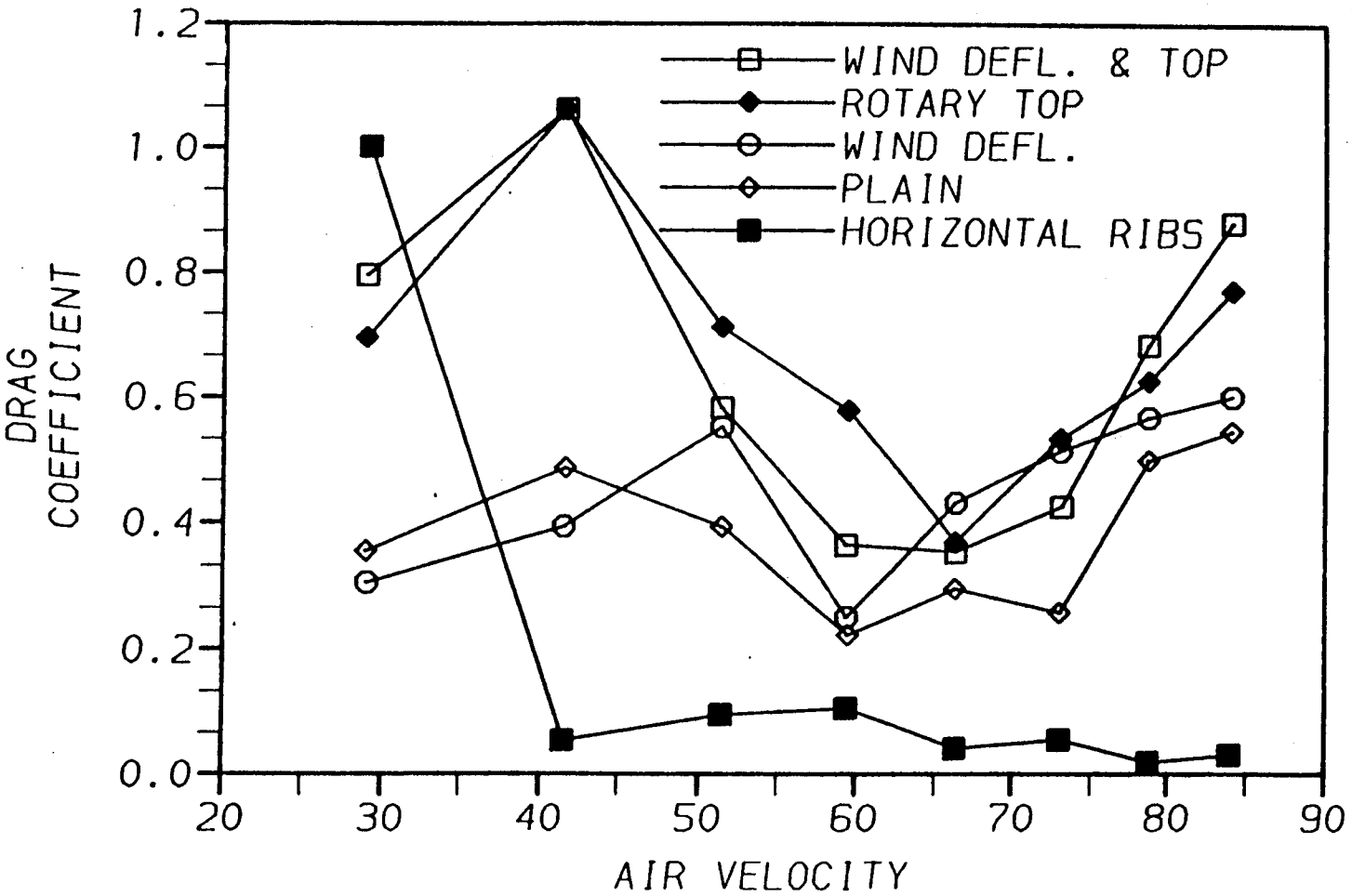
FIG. 3. Wind tunnel data of the drag coefficients of various domes showing the horizontally ribbed dome having the lowest drag coefficient, especially at high air velocities.
Figure 4:
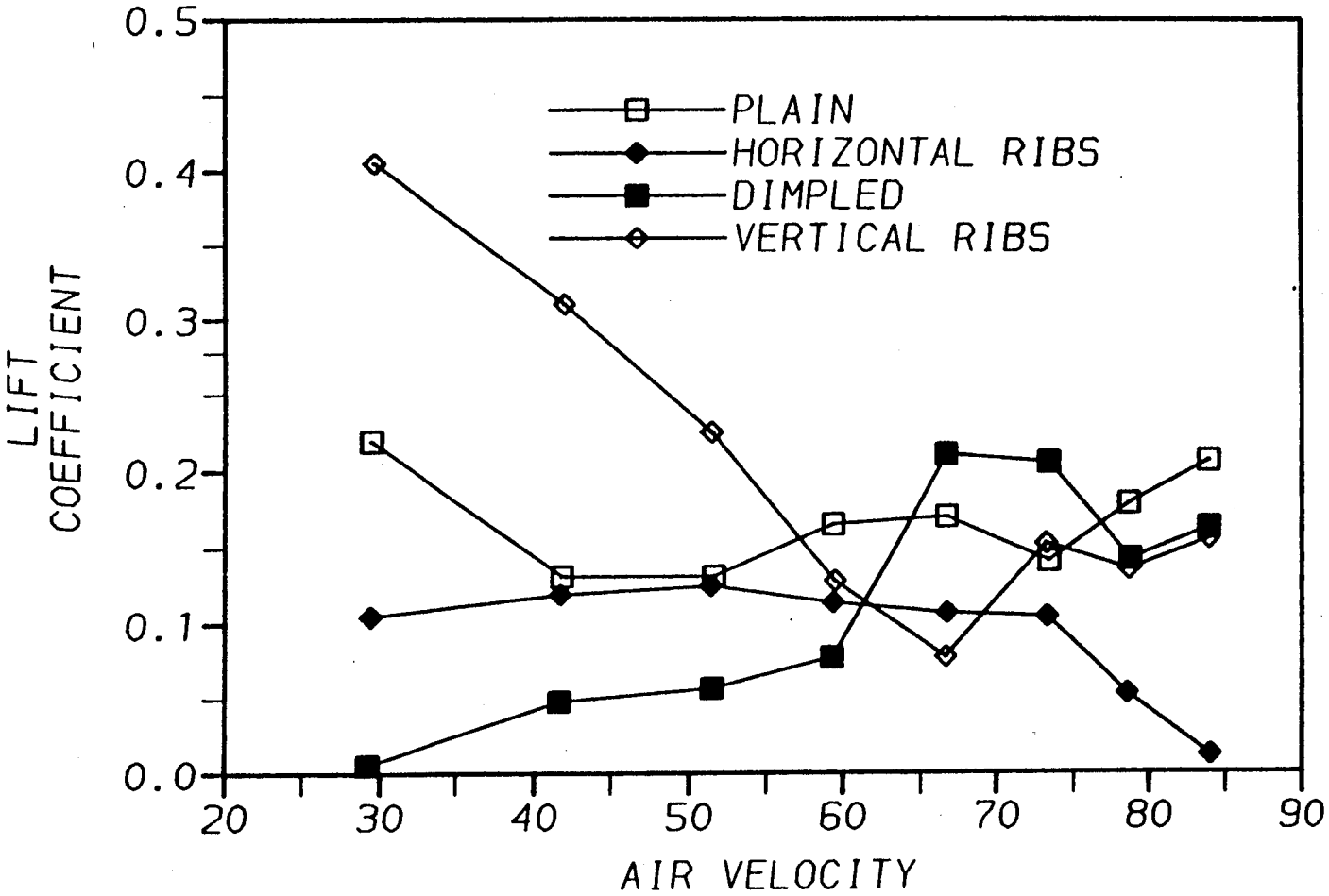
FIG. 4. Wind tunnel data plotted for the lift coefficients of domes with various surface features, showing a relatively low lift coefficient for the horizontally ribbed dome and a greatly reduced coefficient at high air velocities.
Figure 5:
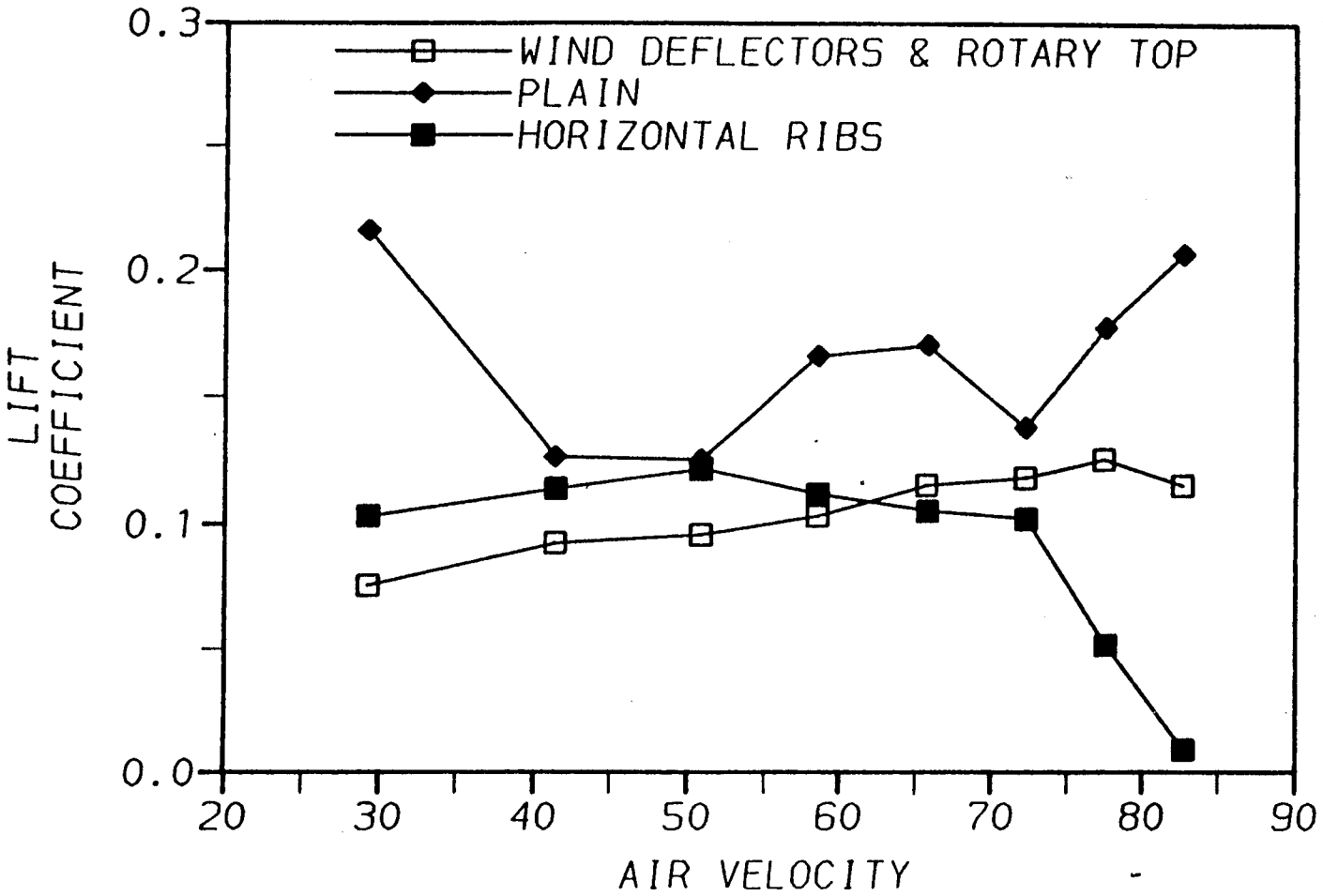
FIG. 5. Wind tunnel data for the lift coefficients of plain, horizontally ribbed and deflector equipped domes. The deflectors reduce the lift coefficient though their primary function would be to deflect projectiles.
Figure 6:
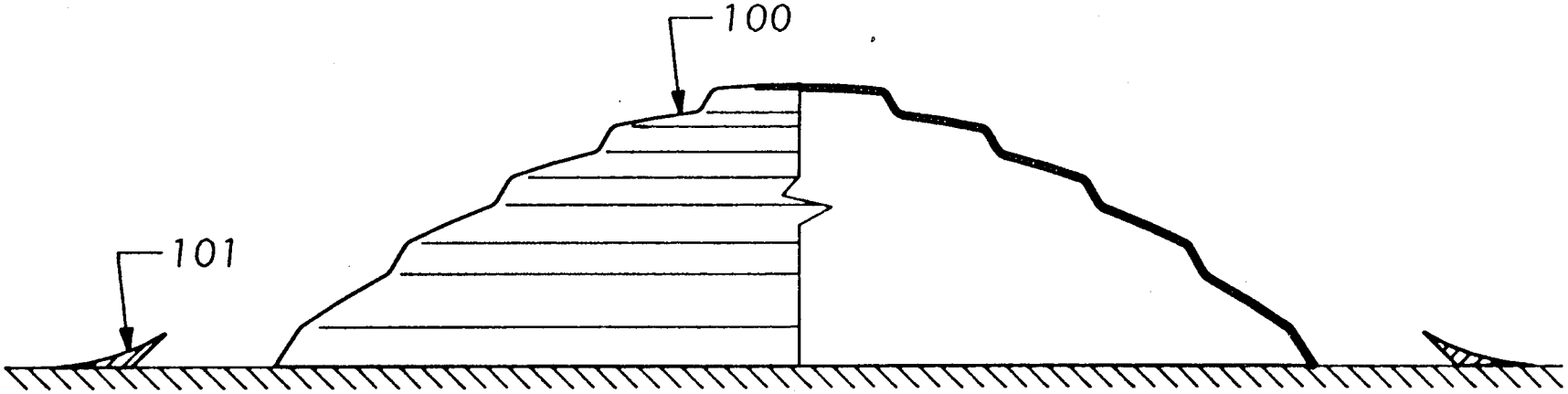
FIG. 6. Transverse section of a horizontal rib.

These results were verified in wind tunnel tests (see FIG. 1 "Lift: Horizontal Ribs vs. Plain Dome" and FIG. 2 "Drag: Horizontal Ribs vs. Plain Dome"). In further wind tunnel testing against a variety of modified domes, the proposed horizontally ribbed dome had by far the lowest drag coefficient and a low lift coefficient. The horizontally ribbed dome was superior in reducing both lift and drag coefficients at higher wind velocities where it is most important to minimize wind effects (see FIG. 3 "Dome Drag Coefficients" and FIG. 4 "Dome Lift: Surface Feature Effects").

A further alternative embodiment of the claimed invention provides for the incorporation of wind deflectors adjacent to the dome. The wind deflectors (see FIG. 7) further reduced the lift coefficient as compared to the plain dome (see figure five "Dome Lift: Wind Deflectors and Horizontal Ribs"), though their main usefulness would be in deflecting projectiles up and over the dome. The design of the wind deflectors is relatively variable, requiring only the provision of a lip or point placed less than a radius distant from the perimeter of the dome to break up the airstream created by the dome. A preferred design provides an inclined face directed away from the dome which essentially lifts the airflow over the top of the dome, or at least aids in lifting that airflow, thereby reducing the direct impact and accordingly drag and lift coefficients exhibited by the dome.

Figure 7:
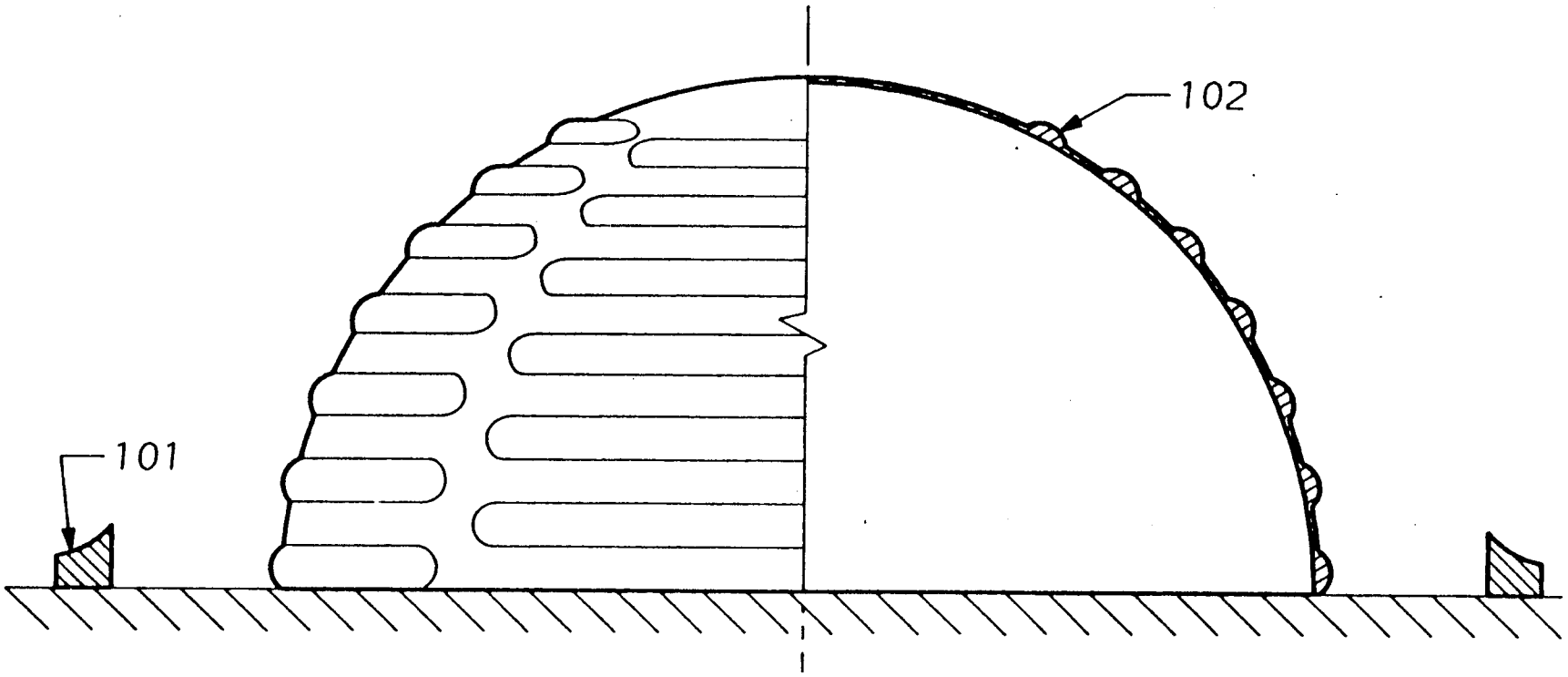
FIG. 7. Illustration of a dome with a wind deflector.

It should be further noted that the ribs need not extend entirely around the circumference of the dome. Ribs 102 extending partially about the dome's circumference provide reduced lift and drag coefficients. An arrangement illustrating ribs 102 extending circumferentially, but not entirely about the dome, is illustrated in FIG. 7.

It should be noted that the materials from which the ribs are prepared can be selected from a wide variety than the materials used to construct the dome, per se. Thus, as they are not loadcarrying elements, per se, the ribs may be made of easily molded material, such as pure thermosetting resins, or similar materials, of low cost and low weight. If the ribs have sufficient strength to maintain their shape, the adherence of the rib to the dome, via adhesive, mechanical attachment, or both, should be sufficient to provide adequate strength to maintain the ribs over time in the face of environmental attack. Again, resistance to radiation, corrosion and the like are factors to be taken into account in selecting materials to use in preparing the ribs. Thermosetting resins constitute a preferred embodiment.

The invention claimed herein has been described in both general terms and by specific embodiment. Alternatives will occur to those of ordinary skill in the art without the exercise of inventive facilities. Such alternatives remain within the scope of the invention, save for the limitations presented in the claims set forth below.

What is claimed as new and desired to be secured by Letters Patent of the United States is:

1. A hemispherical dome suitable for enclosing a human habitation within its interior surface and having an exterior surface exposed to wind, snow and rain opposed to said interior surface, said dome having a radius of at least one-half mile, said dome comprising a plurality of trusses comprised of a graphite fiber-reinforced resin matrix composite material and sheets of substantially transparent styrene methylmethacrylate disposed between said trusses, said dome further comprising a plurality of horizontally disposed ribs extending circumferentially about said exterior surface such that said dome exhibits a drag coefficient no greater than 0.17 and a lift coefficient no greater than 0.09, said dome further comprising a wind deflector, exhibiting an incline surface facing away from said dome, spaced from said dome a distance less than the radius of said dome.

2. The dome of claim 1, wherein said ribs are adjacent, and disposed entirely about said exterior surface.

3. The dome of claim 1, wherein said ribs are laterally displaced, one from another.

4. The dome of claim 1, wherein said dome further comprises a central tower comprised of graphite-reinforced resin matrix composite material, to which said tower said trusses are affixed.

5. The dome of claim 1, wherein said ribs extend only partially about the circumference of said dome.

6. The dome of claim 1, wherein said dome is at least partially transparent to sunlight.

* * * * *